US005794280A

United States Patent [19]

Hansen et al.

[11] Patent Number: 5,794,280

[45] Date of Patent: Aug. 18, 1998

[54] SPA APPARATUS WITH HEAT TRANSFERRING HANGING INTERIOR STRUCTURAL LINER

[75] Inventors: Borg Hansen, Calabasas; Rafael Gonzalez, Palmdale, both of Calif.

[73] Assignee: Softub, Inc., Chatsworth, Calif.

[21] Appl. No.: 780,731

[22] Filed: Jan. 8, 1997

[51] Int. Cl.[6] ..... A61H 33/00

[52] U.S. Cl. ..... 4/541.1; 4/493; 4/545; 165/47

[58] Field of Search ..... 4/541.1–541.6, 4/545, 492, 493; 310/62, 63; 417/372; 607/81–87; 165/47

[56] References Cited

U.S. PATENT DOCUMENTS

| | | |
|---|---|---|
| D. 51,506 | 11/1917 | Miyahara . |
| D. 252,042 | 6/1979 | Jacuzzi . |
| D. 264,129 | 4/1982 | Tulipani . |
| D. 274,455 | 6/1984 | Cuttriss . |
| D. 293,363 | 12/1987 | Everard . |
| 817,314 | 4/1906 | Hahn . |
| 933,954 | 9/1909 | Brattin . |
| 1,450,444 | 4/1923 | McGuire . |
| 1,941,832 | 1/1934 | Gottfried . |
| 1,955,022 | 4/1934 | Rodman . |
| 2,733,711 | 2/1956 | Gibson . |
| 2,734,459 | 2/1956 | Zimsky . |
| 2,805,426 | 9/1957 | Rempel . |
| 2,844,825 | 7/1958 | Gauerke . |
| 3,157,774 | 11/1964 | Moore et al. . |
| 3,300,355 | 1/1967 | Adams . |
| 3,337,384 | 8/1967 | Wright . |
| 3,396,412 | 8/1968 | Francom . |
| 3,571,818 | 3/1971 | Jacuzzi . |
| 3,720,964 | 3/1973 | Thomson . |
| 3,734,811 | 5/1973 | Small et al. . |
| 3,772,714 | 11/1973 | Sealby et al. . |
| 3,886,936 | 6/1975 | Wehrenberg . |
| 3,923,573 | 12/1975 | Hay, II . |
| 3,943,580 | 3/1976 | Carter . |
| 3,970,210 | 7/1976 | Katsuta . |
| 4,118,814 | 10/1978 | Holtom . |
| 4,349,434 | 9/1982 | Jaworski . |
| 4,546,900 | 10/1985 | Lackey . |
| 4,564,962 | 1/1986 | Castleberry et al. . |
| 4,579,617 | 4/1986 | Oberg et al. . |
| 4,658,448 | 4/1987 | Rogers et al. . |
| 4,679,545 | 7/1987 | Cavestany . |
| 4,699,288 | 10/1987 | Mohan . |

(List continued on next page.)

FOREIGN PATENT DOCUMENTS

| | | | |
|---|---|---|---|
| 219730 | 4/1987 | European Pat. Off. | 4/541.4 |
| 312885 | 4/1989 | European Pat. Off. . | |
| 1227969 | 4/1960 | France . | |
| 2087513 | 12/1971 | France . | |
| 3204323 | 8/1983 | Germany . | |
| 3320617 | 7/1984 | Germany . | |
| 3602771 | 10/1986 | Germany . | |
| 3610823 | 7/1987 | Germany . | |
| 4032448 | 1/1992 | Germany . | |
| 6142156 | 5/1994 | Japan . | |
| 904763 | 8/1962 | United Kingdom . | |
| 1381723 | 1/1975 | United Kingdom . | |
| 1592982 | 7/1981 | United Kingdom . | |
| 2171008 | 8/1986 | United Kingdom . | |

*Primary Examiner*—Charles R. Eloshway
*Attorney, Agent, or Firm*—William W. Haefliger

[57] ABSTRACT

A heated therapeutic spa which comprises a spa tub containing water and having plumbing attached thereto, the tub having a wall which is a relatively good thermal conductor; a thermally efficient, insulating container comprising a load bearing outer wall, and a bottom wall; a plenum chamber formed between the tub wall and the container wall and extending about the tub wall; a motor and pump supplying circulating water to the tub and extending in the plenum chamber; a fan located to circulate air that converts heat from the motor into hot air exhausted into the plenum chamber; the fan operating to force the hot exhaust air to circulate around the tub wall, whereby the temperature of the air drops in flowing about the tub wall before returning to the motor.

14 Claims, 6 Drawing Sheets

U.S. PATENT DOCUMENTS

| | | | |
|---|---|---|---|
| 4,829,607 | 5/1989 | Huse . | |
| 4,843,659 | 7/1989 | Popovich et al. . | |
| 4,858,254 | 8/1989 | Popovich et al. . | |
| 4,858,255 | 8/1989 | Haisman | 4/541.4 |
| 4,901,379 | 2/1990 | Chalberg et al. . | |
| 4,981,543 | 1/1991 | Popovich et al. . | |
| 5,022,101 | 6/1991 | Gosselin et al. . | |
| 5,092,951 | 3/1992 | Popovich et al. . | |
| 5,199,116 | 4/1993 | Fischer | 4/541.2 |
| 5,345,621 | 9/1994 | Livingston | 4/541.1 |
| 5,392,473 | 2/1995 | Idland et al. | 4/541.1 |
| 5,428,849 | 7/1995 | Watkins et al. . | |
| 5,454,195 | 10/1995 | Hallsten . | |
| 5,527,412 | 6/1996 | Hansen et al. . | |
| 5,548,852 | 8/1996 | Rowe . | |

(SCHEMATIC)

(SCHEMATIC)

SPA APPARATUS WITH HEAT TRANSFERRING HANGING INTERIOR STRUCTURAL LINER

BACKGROUND OF THE INVENTION

This invention relates generally to hot tubs or spas, more particularly to an easy to manufacture, low-cost, lightweight, insulated, semi-rigid plastic spa, which is made in multiple sections.

Conventional hot tubs or spas are bulky, heavy, non-portable, and expensive in their construction; Also, expensive electrical energy and heat energy is required for their operation. There is need for greatly improved, easily fabricated and assembled spa structure, with the unusual advantages in construction, modes of operation, use and transport, and results, as are now made possible by the present invention, as will appear. There is also need for more efficient heating of water in spa tubs.

SUMMARY OF THE INVENTION

It is a major object of the invention to provide an improved hot tub or spa, meeting the above needs.

Basically, the improved spa tub comprises:

a) a spa tub for containing water, and having plumbing attached thereto, the tub having a wall which is a relatively good thermal conductor, b) a thermally efficient, insulating container comprising a load bearing outer wall, and a bottom wall, c) a plenum chamber formed between the tub wall and the container wall and extending about the tub wall, d) a motor and pump supplying circulating water to the tub and extending in the plenum chamber, e) a fan located to circulate air that converts heat from the motor into hot air exhausted into the plenum chamber, f) the fan operating to force the hot exhaust air to circulate around the tub wall, whereby the temperature of the air drops in flowing about the tub wall before returning to the motor.

As will be seen, the motor, fan, and plenum advantageously comprise means for generating heat for transfer into the air in the plenum, for subsequent transfer via the inner wall into the tub water.

Another object is to provide means, such as a fan, oriented to effect flow of the heated air in the air space, and in a direction about the inner wall, i.e., structural liner, whereby the temperature of the heated air drops in flowing about the structural liner. The fan may advantageously comprise a cooling air fan driven by the electrical motor, whereby the heat loss from the motor is efficiently converted to heat input to water in the spa tub. The fan has an air inflow side and an air outflow side, and is oriented to discharge motor-heated air from the outflow side for flow about the liner and, for return flow at lower temperature to the inflow side of the fan.

A further object is to locate the air-heating means in direct communication with the plenum space, for maximum heat transfer to the air flowing in that space. Thus, the electrical motor may be located between the liner and the spa outer wall structure.

The method of the invention is accomplished by:

a) providing a load-bearing tub side wall having an inner side and an outer side, the tub having an interior to receive liquid, such as water, b) the tub side wall provided to include at least two wall sections, spaced about the interior, the sections assembled end-to-end to form the side wall to extend in a loop, c) providing a flexible liner extending at the inner side of the side wall to contain the liquid, and to provide a plenum air space between the side wall and the liner, and d) providing means to supply heat to air in the air space and adjacent the liner to enable heat transmission from the air to and through the liner, into water in the interior.

As will be seen, the tub wall may typically include at least three of the wall sections, easily assembled end-to-end, with outer wall panel structures connected end-to-end. Cavities are provided in the tub wall; and water and air ducts are located in certain of such cavities. Also, there are typically four of the outer panel structures. Bridges or webs are typically provided at different elevations to define the cavities, which may be cored.

Another object is to provide retention band means extending in a loop about the interconnected sections, to resist their outward deflection.

A further object is to provide the inner liner to be supported by the side wall to extend in a loop to contain transmission toward the side wall of liquid pressure exerted by liquid in the interior. As will be seen, the liner typically hangs to extend generally vertically and is spaced from the inner side of the side wall to contain liquid, such as water, filled into the tub interior.

Yet another object is to construct the spa in multiple sections which can be assembled end-to-end, and held together by strapping enabling disassembly for storage of the sections, and employing a hanging structural liner in the spa to retain spa water, within the assembled sections.

These and other objects and advantages of the invention, as well as the details of an illustrative embodiment, will be more fully understood from the following specification and drawings, in which:

DRAWING DESCRIPTION

DETAILED DESCRIPTION

Figure 1:
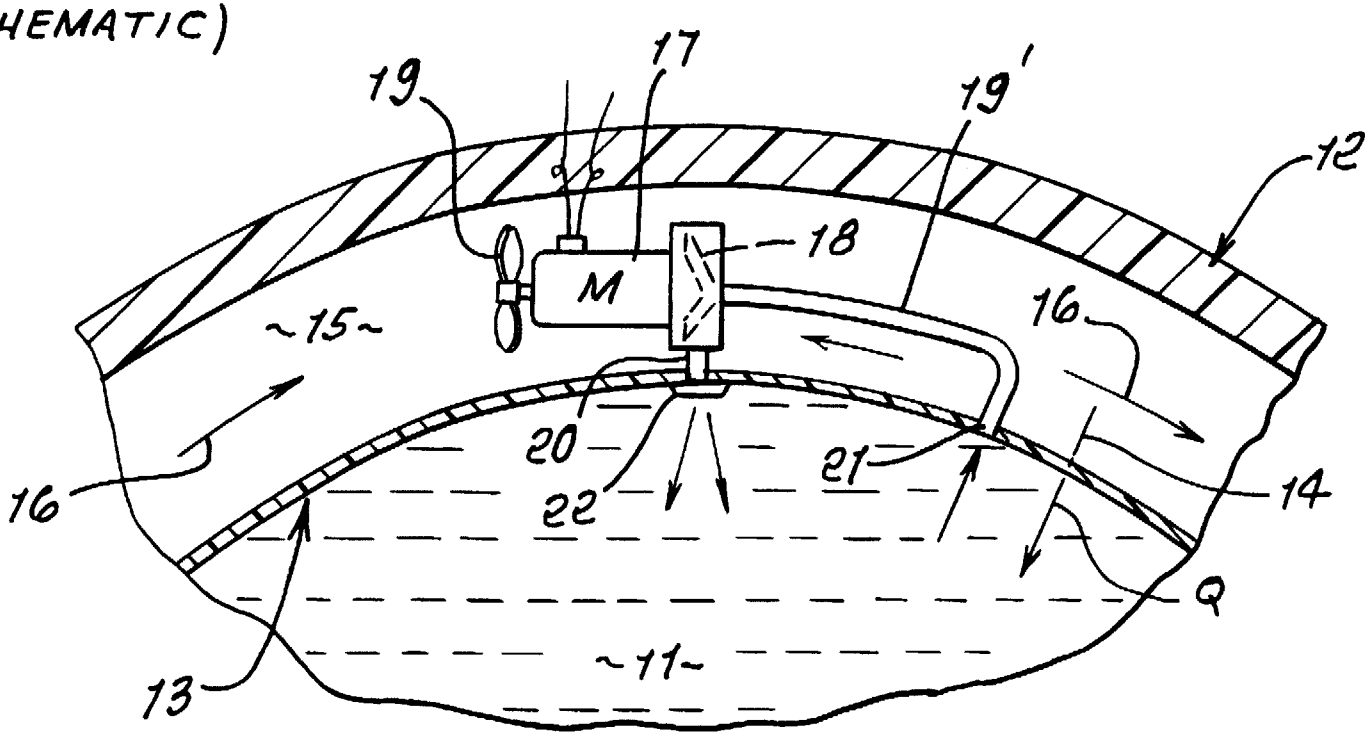
FIGS. 1 and 2 are schematic plan views of apparatus incorporating the invention.

Reference will first be made to the schematic plan views of FIGS. 1 and 2. As illustrated, a spa tub surrounds and contains water 11. The tub includes a sturdy outer wall 12, which is heat insulative, and an inner wall 13, which is a relatively good thermal conductor. It is an object of the invention that heat be transferrable through the inner wall to the water 11 in the tub. See arrows 14 designating flow of heat through inner wall 13, which may be quite thin, and comprise a liner hanging generally upright. Outer container wall 12 may be load bearing, and may support inner tub wall 13.

A plenum chamber 15 is formed between the two walls 12 and 13, and typically extends circumferentially or peripherally about tub wall 13, in order to pass air flow generally horizontally about wall 13. See flow arrows 16. Means is provided to circulate warm or hot air in the plenum chamber about wall 13, in order to supply heat for flow through wall 13 into the tub water 11. Since circulation tends to disrupt boundary layers of air adjacent wall 13, which would impede heat transfer, circulation promotes heat transfer through wall 13. Also, such circulation assures warm or hot air supply to portions of the wall 13 at all sides of the water in the tub.

The air circulating means preferably comprises a motor-driven fan 19 located to displace the air to circulate, as referred to. The fan preferably is openly located in the chamber 15 to displace air in heat-transfer relation with an electrical motor unit 17 that drives a water-circulating pump 18. Heat from the motor is directly transferred to the fan-displaced air, as that air is driven around the plenum chamber, and so that cooled air returning to the fan may again or repeatedly be heated by the motor. Warm air is cooled in the sense that heat is extracted from the air to flow through the inner wall 13, as referred to.

Pump 18, driven by the motor, receives tub water, as via an input duct 19, and discharges such water to output duct 20, to be jetted into the tub water. See water drain or outlet 21 to duct 19, and jet 22 connected to duct 20.

Figure 2:
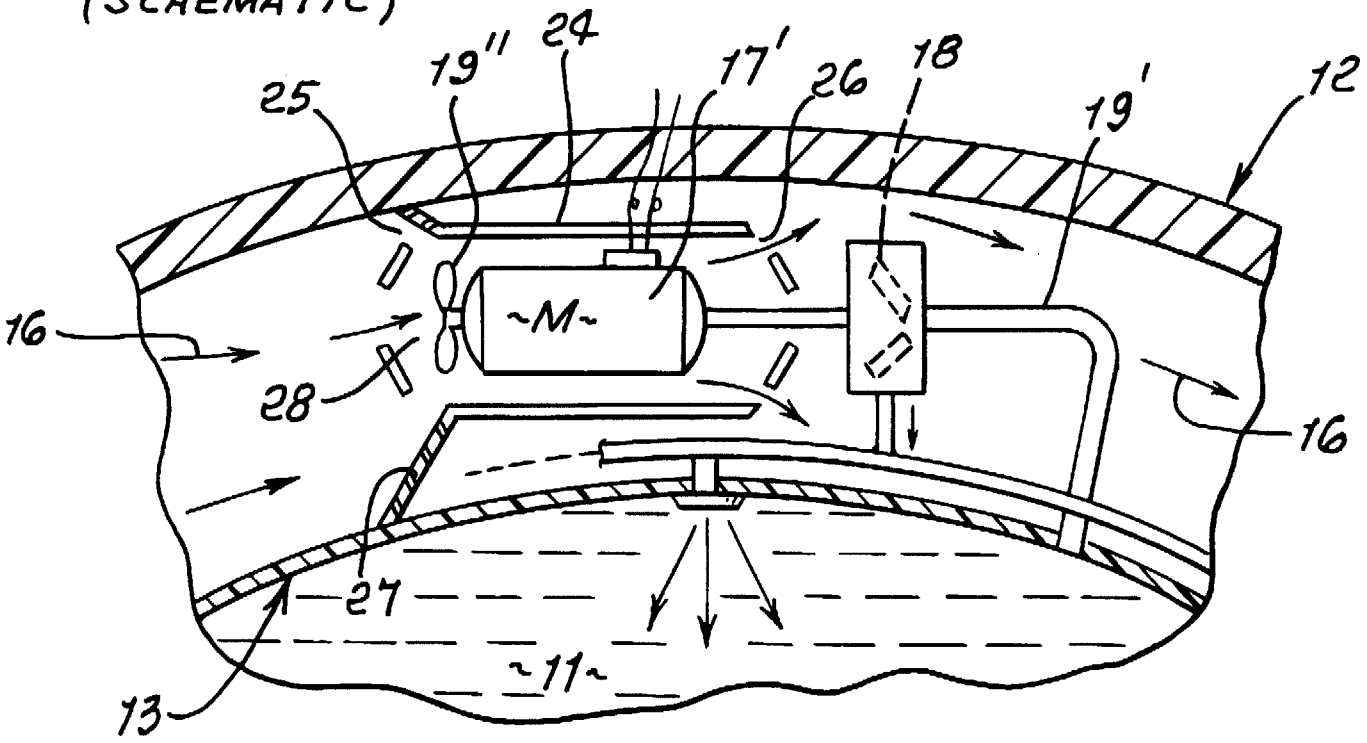

FIG. 1 shows the fan 19 as directly exposed to the plenum air flow; whereas, in FIG. 2 the fan is located within a housing 24 that shrouds the motor. That housing has air inlet and outlet ports or openings at 25 and 26. Baffles 27 extending crosswise in the plenum chamber direct circulating air toward inlet ports 25, to ensure air flow into the housing interior 28 to flow adjacent the motor, as shown, for enhanced heat transfer to the flowing air. Note that the direction of air flow in the plenum about the wall 13 is maintained, for efficiency.

FIG. 2 is like FIG. 1 except that the fan 19' and motor unit 17' are located within housing 24 having air entrance and discharge ports 25 and 26. Baffling 27 deflects approaching air to flow into and through the housing.

Figure 3:
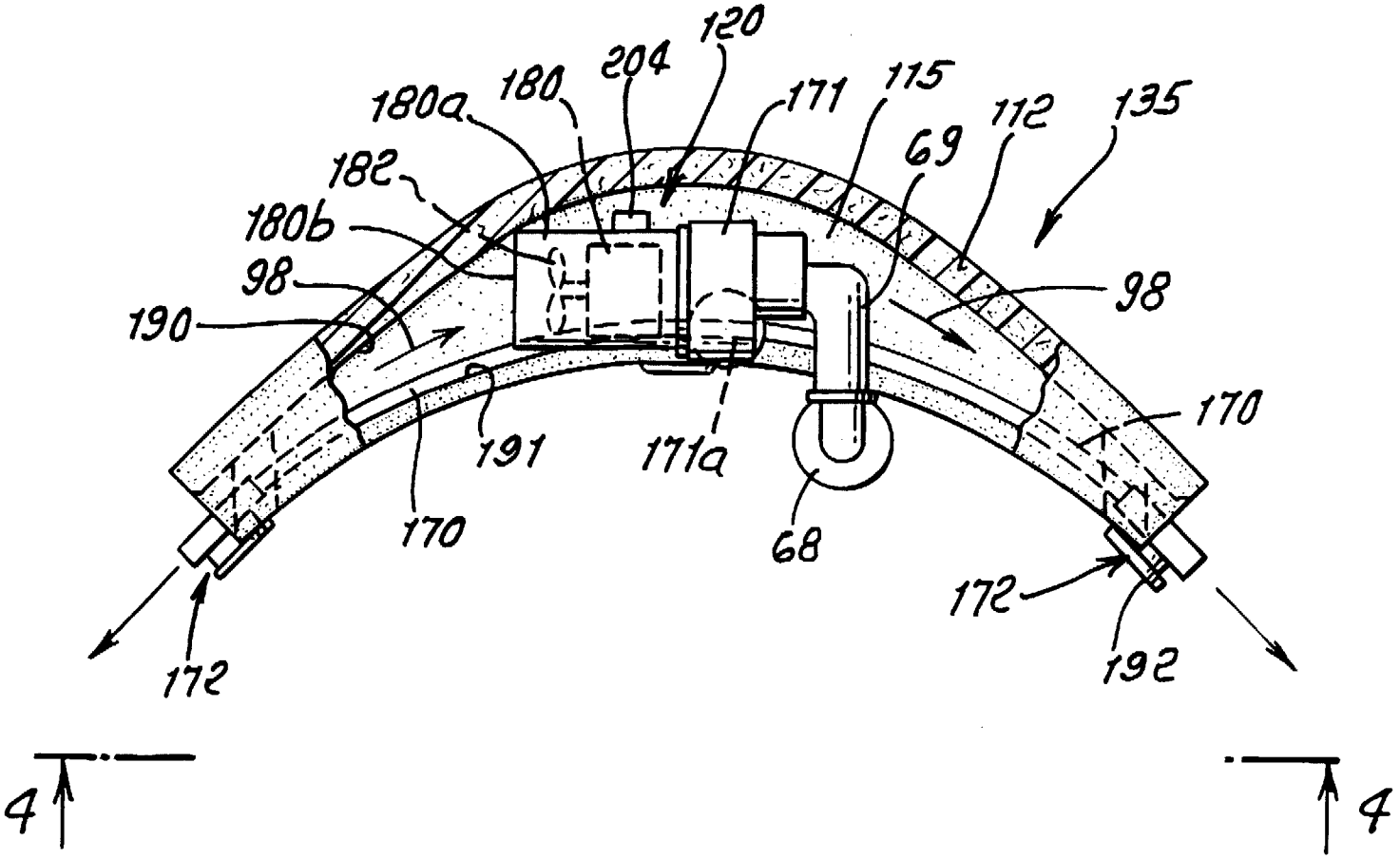
FIG. 3 is a plan view of a tub section showing details of the invention.
Figure 4:
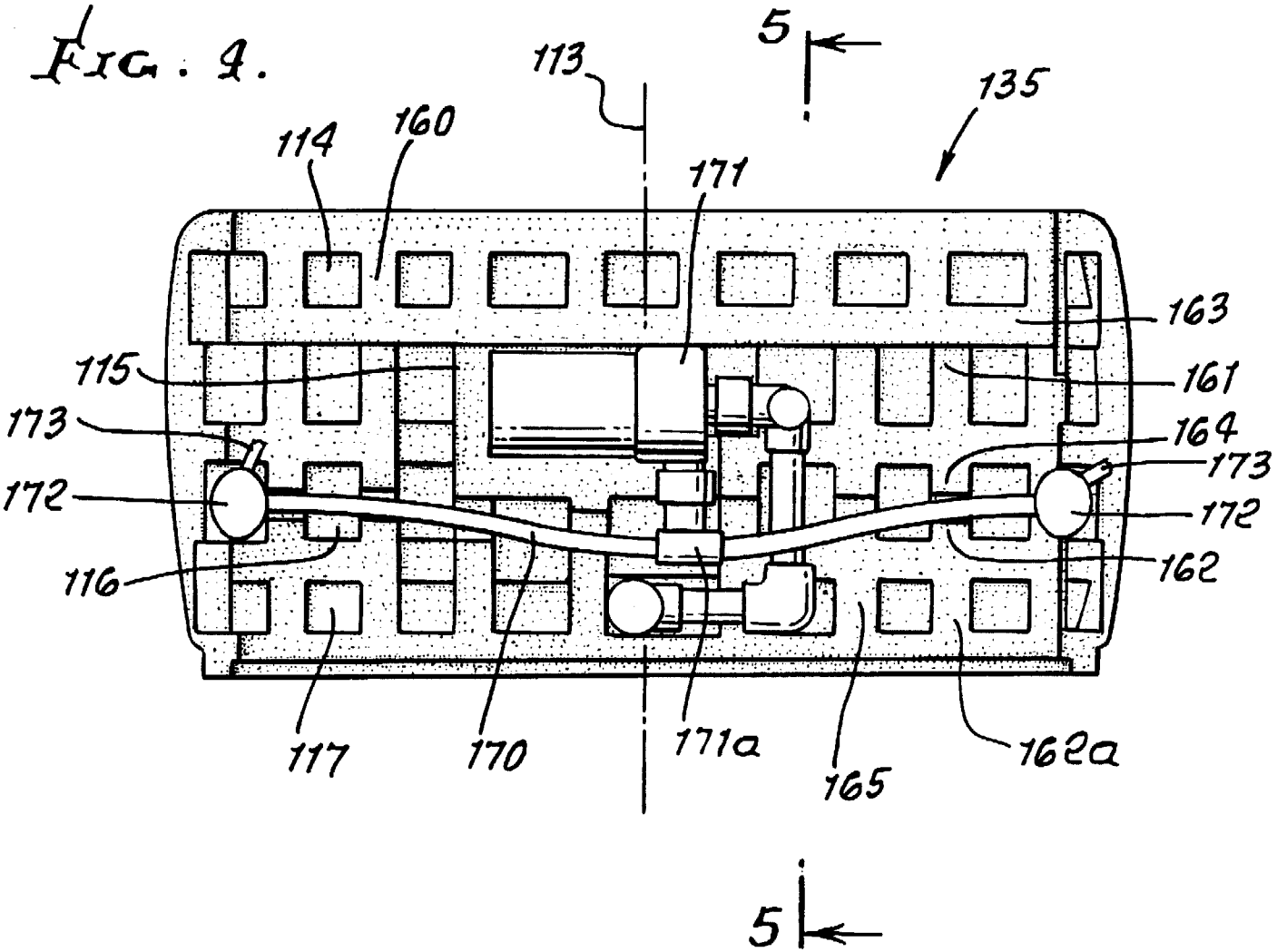
FIG. 4 is an elevation taken on lines 4—4 of FIG. 3.
Figure 5:
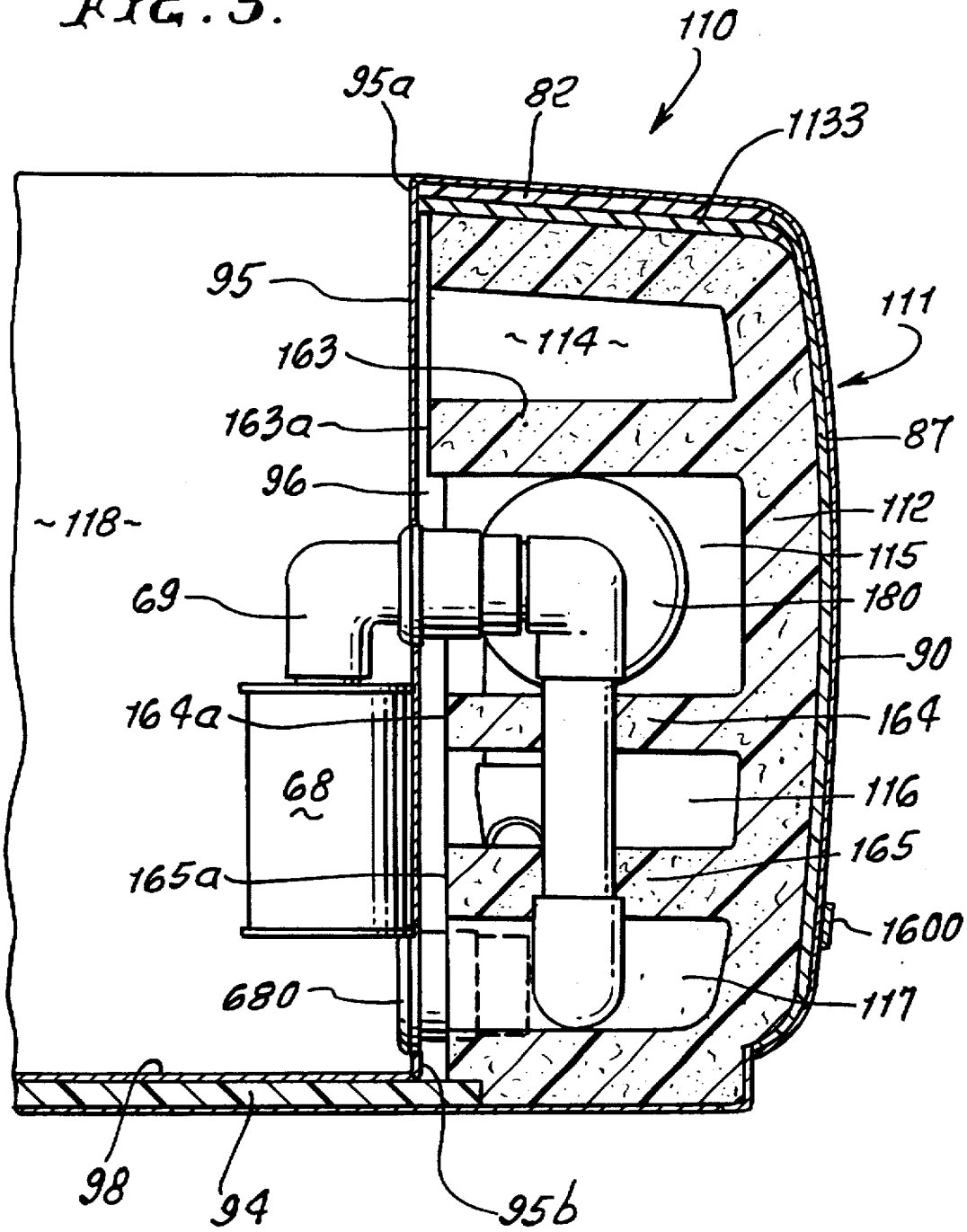
FIG. 5 is an enlarged vertical section taken on lines 5—5 of FIG. 4.
Figure 6:
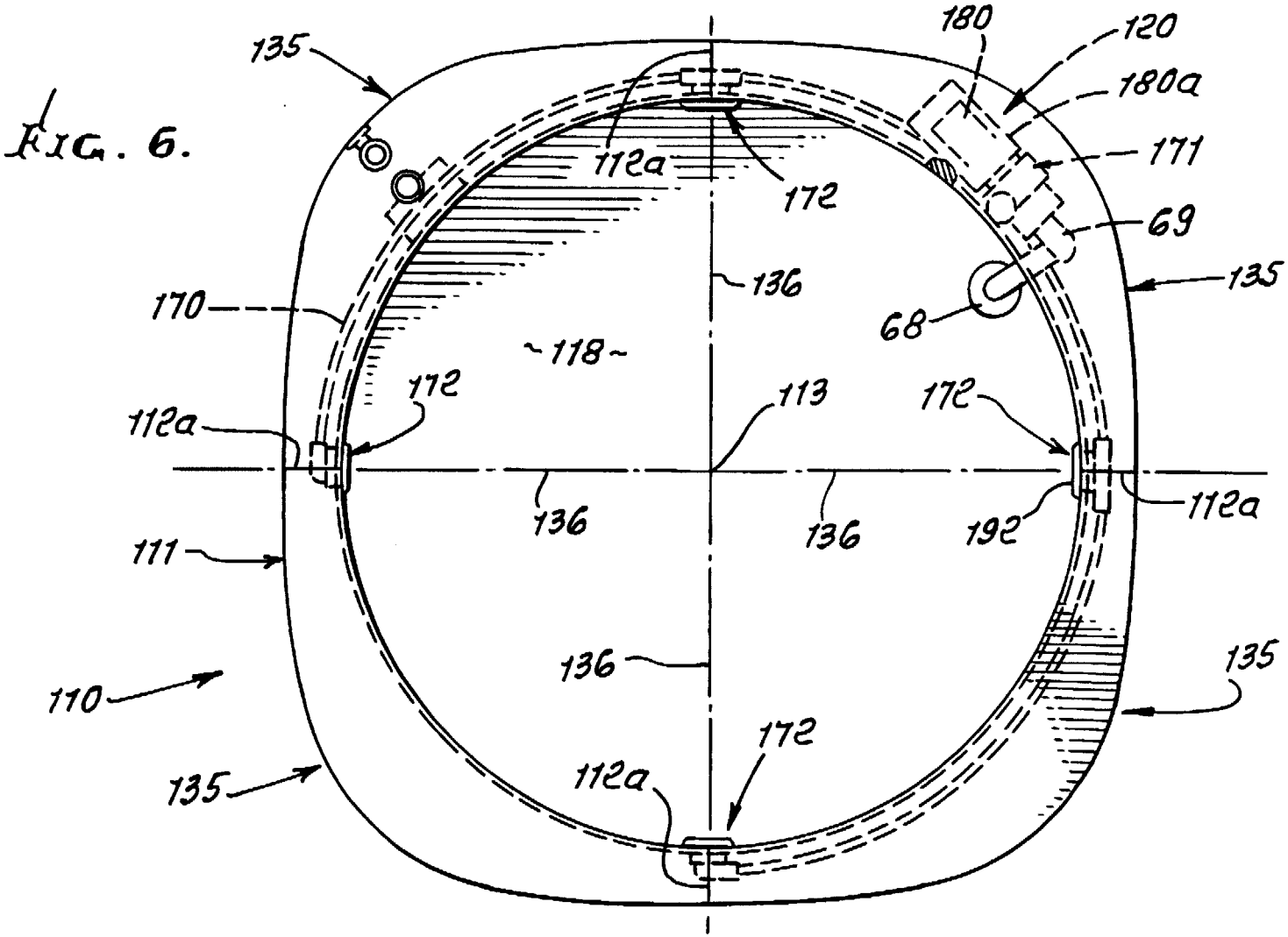
FIG. 6 is a plan view of an assembled tub consisting of multiple sections.

Refer now to FIGS. 3–6, showing an actual installation on a tub 110, having looping, upstanding, self-supporting, light-weight side wall 111. The wall includes an inner panel structure 112 that is self-supporting and load bearing. Panel structure 112 extends upright throughout substantially the entire height of the side wall 111. It may typically consist of synthetic resin, and examples are foamed or gas-expanded polystyrene, and foamed or gas-expanded polypropylene, formed as molded and curved blocks or sections 135 that interfit end-to-end, as for example are shown in FIGS. 3 and 6. They may be adhesively bonded together at their end interfit locations **112*a* seen in FIG. 6. The sections may be held together by strapping, as at 1600 in FIG. 5**, extending about the sections, to form a tight unit, and to enable their disassembly, if the section ends are not adhesively bonded.

For example, four such sector-shaped panels 112 may be interconnected end-to-end in a loop, as by adhesive bonding, to define the looping tub wall. Note that two or more of the sections may be adhesively bonded to form section combinations, such as for example, two combinations, each formed by two sections bonded end to end. The two combinations may be easily stored after disassembly. Panel structures 112 are cored, as shown, whereby looping space or spaces, i.e., a plenum passage, are formed, as at 115 through 116 at different horizontal levels, and extending about central upright axis 113. That passage corresponds to plenum chamber 15 described above. See FIGS. 4 and 5. See also spaced vertical webs or bridges 160, 161, 162, and **162*a*, and spaced horizontal webs or bridges 163–165. Cored spaces 116 are interconnected in series, as by cut-outs that pass water ducting 170 extending from the outlet 171*a* of pump 171 to jet nozzles 172**.

Ducting 173 flows air to the nozzles 172 that communicate through a hanging structural wall or liner 95, corresponding to wall 13 described above, for delivery of aerated water jets to the tub interior 118 bounded by the liner 95, which is spaced at 96 from the wall 111, i.e., from inner terminals **163*a*–165*a* of bridges 163–165. Space 96 and spaces 115** form a plenum chamber.

Air is typically supplied for mixing with water, as for example was disclosed in U.S. Pat. Nos. 4,858,254 and 4,843,659, incorporated herein by reference. Jet orifice plates are shown at 192. See U.S. Pat. No. 5,527,412, incorporated herein by reference.

As appears in FIG. 6, the four sector-shaped wall sections 135 are generally alike and assembled end-to-end, to form a looping, upstanding, unitary self-supporting tub wall 111, capable of disassembly for storage, if all the sections are not adhesively connected. The ends of the outer panel structures are located at four radial axial planes 136.

A source of fluid, such as a water pump 171, within a pumping unit 120, circulates water under pressure, to the ducts 170 for delivery to the jet nozzles 172, as referred to. Return ducting 69 in one wall section 135 re-circulates water from the tub interior to the pump unit, as via a drain fitting 680 and filter 68. See for example the pump unit and circulation path, as shown in U.S. Pat. No. 5,092,951, incorporated herein by reference. Motor 180 in housing **180*a* drives the pump, and also drives a fan indicated at 182. Air is circulated past the motor and through the plenum, as referred to above. See arrows 98 in FIG. 3. Motor controls may be provided at 204**, in the path of the air flow.

Referring to FIG. 5, a foam plastic support or cap is provided at 1133 to provide a comfortable arm rest, or seat, for the tub user, as for example during climbing into or out of the tub. The upper surface of the support is shown as upwardly flat, in axial radial planes; and it may extend in a complete horizontal loop, and over and in association with the tub looping upstanding wall 111, to rigidize the structure.

An outer, flexible jacket is shown at 90 in FIG. 5, and extends adjacent or near to the outer side of the tub wall 111. Specifically, it is shown as conforming closely to the shape of an outer, vertical pad 87, i.e., extending downwardly adjacent that pad. The annular jacket 90 preferably consists of a thin sheet of marine grade polyvinyl material or similar protective outdoor fabric; and pad 87 may consist of foam plastic material. The upper end of the jacket is attached to or integral with a top cover or top liner 82 covering the top of cap 1133, as shown.

Accordingly, the jacket 90 has multiple functions, i.e., it protectively covers the outer side of the tub side wall; it is retained to top cover 82; and it protectively covers the outer padding 87.

Inner structural liner 95 seen in FIG. 3 hangs from top cover 82 and is spaced at 96 from the inner side of the tub wall 11, i.e., inner surfaces **163*a*–166*a* of the bridges. The liner 95 preferably consists of a sheet of waterproof, flexible, polyvinyl material, or similar waterproof, flexible sheet. Upper edge extent 95*a* of the liner or sheet may be attached to or be integral with the cover 82. The lower edge extent 95*b* of liner sheet 95 meets and is bonded to (as by RF weld or heat weld) the bottom vinyl sheet 98 protectively (and waterproof) forming the bottom wall of the tub, as on a foam plastic panel 94. This enables easy and quick tub assembly, since after the wall sections are set up in a loop, and annular support 1133 applied downwardly over the wall top, the liner material may be quickly applied to the wall 111, with inner liner 95** hanging, as shown.

Note that hanging liner 95 is structural, in that it at least partly supports the filter unit, it acts as the barrier to water in the tub, and it supports jets 172, as seen in FIG. 3. Liner 95 also conducts heat from the plenum chamber to water in the tub, as referred to above. Bridge surfaces 164*a* and 165*a* limit outward local deflection of the hanging liner, as may occur as a bather moves against the liner in the tub. Jets 172, connected to ducting 170, and carried by the liner, tend to resist deflection of the liner 95.

In the example, electrical motor 180 produces heat during its operation, such heat being transmitted to air flowing past the motor in plenum chamber 96 about the liner 95, whereby heated air transmits heat to the liner, which in turn conducts heat to water at 118. As shown in FIG. 3, the means to effect flow of air advantageously includes a cooling air fan or blower indicated at 182, as driven by motor 180, within housing 180*a*, in such manner as to effect flow of cooling air over or adjacent the motor, to cool the latter, and also to heat water in the tub.

Heated air is discharged from the outflow side of the fan, to flow or circulate in space 96, about and adjacent the liner 95, whereby the air temperature drops from level $T_1$ at the outflow side of the fan to lower level $T_2$ part way about the liner, to lower level $T_3$ at over half way about the liner, to lower level $T_4$ at the inflow side of the fan. Ducting or baffling at 190 and 191 may lead the flowing air back into the fan inflow side, as shown, housing 180*a* being open at 180*b*. Level $T_1$ may be between about 150° F. and 170° F.; and level $T_4$ may be between about 110° F. and 130° F. Accordingly, heat flows (see $Q_1$–$Q_4$) through the liner and into the water body at circumferential points about the liner. Also, the motor itself is advantageously located in the plenum to radiate and conduct heat directly into the air flow in the plenum.

Accordingly, there is provided an efficiently heated hydrotherapy space, which has a double wall construction and is characterized as having:

1. a water-containing inner wall having low thermal resistance to the transfer of heat through it from one side to the other;
2. a substantially continuous outer wall of high-thermal resistance surrounding the inner wall;
3. a looping air plenum space between the inside of the outer wall and the outside surface of the inner wall, which is exposed to substantially all of the underwater wall surface area of the inner wall and capped at the upper edge to create an essentially closed space;
4. a water pump with ducts connected between the pump and the inner wall, so as to be able to circulate water through the pump to and from the body of water inside the inner wall;
5. an electric motor to drive the pump, the motor located in thermal relation to the air space of the plenum and unavoidably generating waste heat in the process;
6. a fan in the plenum space, which drives air in a closed loop past the motor, and around the looping plenum, back to the fan, picking up heat from the motor and then losing heat to the inner wall as it flows around the loop, causing the air to act as an efficient medium to transfer the waste heat from the motor to the inner wall, and then through it to the water, while the high-thermal resistance of the outer wall prevents that same heat from being lost to the outside environment;
7. controls to operate the pump and motor, as required, to generate sufficient heat to keep spa at desired temperature;
8. a motor designed to be easily air cooled;
9. baffles around the fan sealed from the cap to the bottom and between the inner wall and the outer wall to insure air flow around the loop;
10. a similar baffle around the motor sealed between the inner wall and outer wall to insure air flow through the motor cooling zone;
11. both baffles may be the same;
12. an insulated bottom wall underneath the bottom inner wall of spa and extending to outer wall;
13. an additional air plenum between bottom wall and underside of bottom inner wall with baffle or baffles to cause the air to flow past a substantial fraction of the bottom before returning to the fan;
14. fan driven by the same motor as the pump
    - fan inside motor housing
    - fan outside motor housing;
15. pressure-sensitive vents which will allow water to escape in case of a leak, but not the looping air;
16. controls for the motor may be in thermal contact with the air in the plenum, so as to cool the controls;
17. thin inner wall with lowest thermal resistance—stiff and strong in tensile loading, but flexible, with insulated outer wall forming a seat around the perimeter of the spa and holding up the top edge of inner wall;
18. other heat-generating accessories located in plenum;
19. hydrotherapy jets which aspirate air into spa for hydrotherapy drawing heated air from plenum as air source;
20. use of additional heat source to heat air for circulation: solar, electric, gas;
21. addition of turbulence promoters in the plenum to increase heat transfer rates;
22. addition of baffles to control air flow direction around the loop to increase heat transfer rates.

We claim:

1. A heated therapeutic spa comprising, in combination:

a) a spa tub containing water and having water circulating plumbing attached thereto, the tub having an inner wall which is thermally conductive, b) the tub further having a thermally insulative load bearing outer wall, and a bottom wall, c) a plenum chamber formed between the inner wall and the outer wall and extending about the inner wall, d) a motor and pump for circulating water in the tub through said water circulating plumbing, the motor and pump being in operative communication with said plenum chamber, e) a fan operating in conjunction with said motor and driven thereby to circulate air in the plenum chamber that is heated by the operation of the motor, f) the fan operating to force the heated air to circulate through the plenum chamber, and from the location of the motor and around the inner wall, whereby the heat from the air is conducted through said thermally conductive inner wall to the water in said tub to heat the water, the temperature of the air decreasing as it flows around the inner wall before returning to the location of the motor.

2. The combination of claim 1 wherein the fan is located within the plenum chamber.

3. The combination of claim 1 wherein the motor includes a housing, and the fan is located in said housing.

4. The combination of claim 1 including baffle means associated with the fan to air flow in said plenum chamber.

5. The combination of claim 1 including baffle means associated with the motor to ensure air flow through a cooling zone associated with the motor.

6. The combination of claim 1 including baffle means associated with the fan and motor to air flow in the plenum and to ensure air flow through a cooling zone associated with the motor.

7. The combination of claim 1 wherein the fan is operatively connected to the motor to be driven thereby.

8. The combination of claim 7 wherein the fan has an inflow side and outflow side and is oriented to discharge the heated aire from said outflow side for flow about the innerwall and for return flow at a lower temperature to the inflow side of the fan.

9. The combination of claim 1 wherein said motor is in said plenum.

10. The combination of claim 1 wherein the inner and outer walls are comprised of multiple panels retained in assembled relation.

11. The combination of claim 10 including at least one of the following acting to hold the panels in assembled relation:

i) adhesive material ii) interfit of panels iii) looping strap means iv) a combination of two or more of i), ii) and iii).

12. The combination of claim 1 wherein said spa tub has four arcuate corner regions, whereby the spa tub has a modified rectangular configuration.

13. The combination of claim 12 wherein each of said corner regions tapers from the midpoint to the ends thereof.

14. The combination of claim 2 wherein said motor is contained within one of said corner regions.

* * * * *

UNITED STATES PATENT AND TRADEMARK OFFICE

CERTIFICATE OF CORRECTION

PATENT NO. : 5,794,280

DATED : August 18, 1998

INVENTOR(S) : Borg Hansen, Rafael Gonzalez and Roc V. Fleishman

It is certified that error appears in the above-indentified patent and that said Letters Patent is hereby corrected as shown below:

On the title page, at [75] after "Rafael Gonzalez, Palmdale" add --Roc V. Fleishman, Venice--

On summary page at [75] change "both" to --all--

Signed and Sealed this

Twelfth Day of January, 1999

*Attest:*

*Attesting Officer*

*Acting Commissioner of Patents and Trademarks*